United States Patent [19]

Hamashima

[11] 4,221,049

[45] Sep. 9, 1980

[54] HAIR CLIPPER

[75] Inventor: Tetsuo Hamashima, Hikone, Japan

[73] Assignee: Matsushita Electric Works, Ltd., Osaka, Japan

[21] Appl. No.: 927,983

[22] Filed: Jul. 26, 1978

[30] Foreign Application Priority Data

Jul. 30, 1977 [JP] Japan ..... 52-92683

[51] Int. Cl.[3] ..... B26B 19/22

[52] U.S. Cl. ..... 30/195

[58] Field of Search ..... 30/223, 195, 225, 221, 30/222

[56] References Cited

U.S. PATENT DOCUMENTS

| | | | |
|---|---|---|---|
| 1,430,173 | 9/1922 | Malvick | 30/221 |
| 2,465,694 | 3/1949 | Norwood | 30/221 |
| 2,470,287 | 5/1949 | Carter | 30/195 |
| 3,193,925 | 7/1965 | Hawley | 30/223 X |
| 3,218,710 | 11/1965 | Bruck | 30/222 |

FOREIGN PATENT DOCUMENTS

| | | | |
|---|---|---|---|
| 18632 | of 1910 | United Kingdom | 30/223 |

*Primary Examiner*—Jimmy C. Peters

*Attorney, Agent, or Firm*—Burns, Doane, Swecker & Mathis

[57] ABSTRACT

A hair clipper comprising a fixed blade and a movable blade which performs a sliding movement in a pressed contact with said fixed blade, wherein each cutting tooth of said movable blade moves to cross accurately its corresponding cutting notch of the fixed blade, so that the hair caught between said notches of the fixed blade can be cut perfectly.

5 Claims, 7 Drawing Figures

HAIR CLIPPER

This invention relates to a hair clipper, more particularly, to a hair clipper for use in cutting hair thinly.

A conventional hair clipper of the kind referred to usually has a structure that the pitch of the cutting notches of a fixed blade differs from that of the cutting teeth of a movable blade so that when said movable blade reciprocates, a plurality of cutting teeth of the movable blade will cross a single cutting notch of said fixed blade. Such a conventional clipper, however, possess the defect that the cutting teeth of the movable blade occasionally cross the notches of the fixed blade incompletely during the reciprocation, because the movable blade (the pitch of which is different from that of the fixed blade) reciprocates at a fixed amplitude, and thereby imperfect cuttings of the hair such as half cutting shown in FIG. 1A may occur, which will be a cause to produce split or branched hair as shown in FIG. 1B. The present invention has been suggested to solve the abovementioned defect.

Accordingly, the present invention has successfully removed the defect by a hair clipper comprising a fixed blade and a movable blade which performs sliding movements in a pressed contact with said fixed blade and so designed that one stroke range of the sliding movement of each comb-shaped cutting tooth of said movable blade can cover entirely one corresponding cutting notch of the fixed blade.

A primary object of this invention is to provide a hair clipper which enables perfect cutting of the hair and prevents such incomplete cutting as half cutting which will be a cause to produce split or branched hair.

Another object of this invention is to provide a hair clipper of a lower cutting resistance.

Still another object of this invention is to provide a hair clipper which enables perfect cutting of the hair even when the hair is entangled.

Figure 1A:
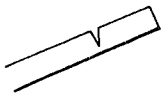
Figure 1B:
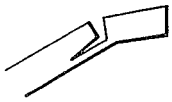
Figure 2:
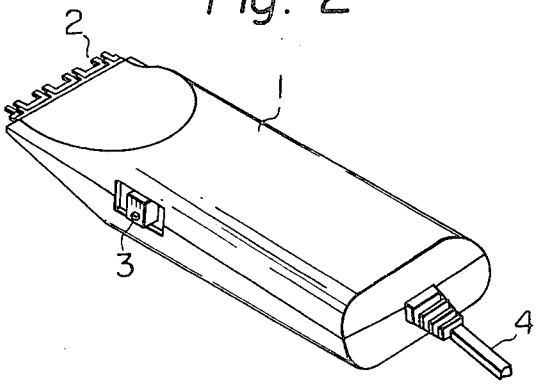
Figure 3:
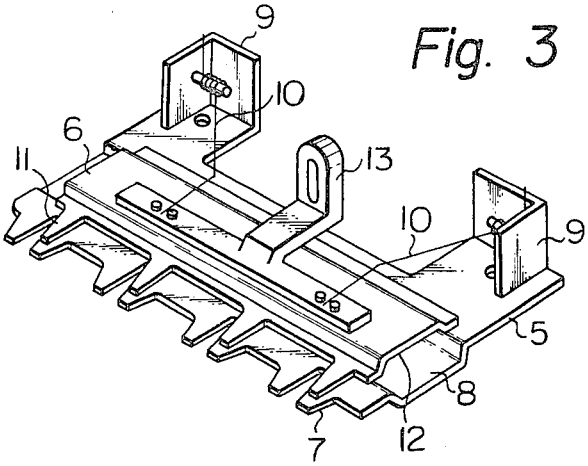
Figure 4:
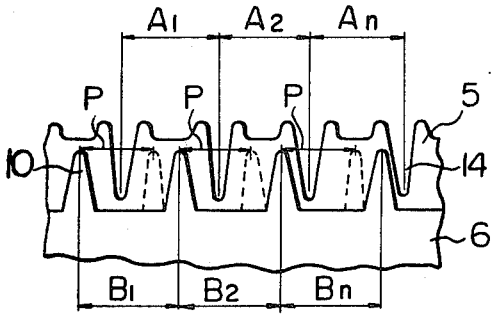
Figure 5:
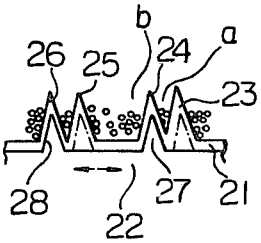
Figure 6:
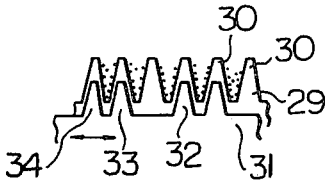

Other objects and advantages of the present invention shall be made clear upon reading the following description of the invention detailed with reference to preferred embodiments thereof shown in accompanying drawings, in which:

- FIGS. 1A and 1B show split hair and branched hair respectively;
- FIG. 2 is a perspective view of a hair clipper according to the present invention;
- FIG. 3 is a perspective view of the fixed and movable blades of the present invention;
- FIG. 4 shows the relation between the cutting teeth of the movable blade and the cutting notches of the fixed blade; and
- FIGS. 5 and 6 show other embodiments of the fixed and movable blades respectively.

In FIG. 2 showing a perspective view of the entire hair clipper, member 1 is a casing, member 2 is a blade assembly comprising fixed and movable blades, member 3 is an operation switch provided on the casing, and member 4 is a power feeding cord. Inside the casing 1, there is housed a reciprocation driving mechanism (not shown) consisting of a motor, eccentric cam and electromagnetic vibrator.

In FIG. 3, showing the fixed blade 5 and the movable blade 6 in detail, the fixed blade 5 is provided at its tip with a plurality of comb teeth which define cutting notches therebetween at suitable intervals. On the blade body, a shallow U-shaped concave 8 is formed for increasing the strength of the blade 5. At both corners of the base part of the blade, L-shaped spring supporting stays 9 are arranged respectively, to which are secured base members of pressing springs 10 for pressing the movable blade against the fixed blade 6. The movable blade is provided at its tip with a plurality of comb-shaped cutting teeth 11 and on the blade body, a shallow U-shaped concave 12 is formed for increasing the strength as in the fixed blade. These concaves 8 and 12 formed on the fixed and movable blades respectively serve to reduce the contact area of the blades, so that the blades can slide with less friction. To the blade body is further secured a driving rod 13 and the movable blade is pressed against the fixed blade by means of the pressing springs 10. The driving rod is given reciprocation by known driving means (not shown).

In FIG. 4, showing the relation between the cutting notches of the fixed blade and the cutting teeth of the movble blade, the fixed blade 5 has cutting notches 14 arranged with desired pitches $A_1, A_2, \ldots A_n$, whereas the movable blade 6 has cutting teeth 11 arranged with pitches $B_1, B_2, \ldots B_n$ which are slightly different from the pitches $A_1, A_2, \ldots A_n$. The hair entering the cutting notches 14 is cut by the cutting teeth 11 which cross the cutting notches during reciprocation and thereby the shearing is carried out. Here the pitches $A_1, A_2, \ldots A_n$ and $B_1, B_2, \ldots B_n$ are sized to satisfy the expression $A_i \neq B_i$ and meet the condition that when the pitches $A_1, A_2, \ldots A_n$ are mutually equal (thereby defining a uniform frequency of the notches), the pitches $B_1, B_2 \ldots B_n$ are not equal mutually (thereby defining a non-uniform frequency of the teeth) and vice versa.

According to such a structure, the hair is not cut simultaneously in all the notches 14 of the fixed blade 5 into which the hair enters but with cutting timings slightly different between respective notches, and thereby the cutting resistance can be highly reduced. Further, the amplitude P of the movable blade is so determined that each cutting tooth of the movable blade can completely cross or traverse only one cutting notch of the fixed blade corresponding to the cutting tooth. In other words, during the reciprocation of the movable blade on the fixed blade, each tooth 11 of the movable blade is to pass over its corresponding cutting notch 14 of the fixed blade and at the halting times of the movable blade on the right and left extreme positions, the cutting edges on the both sides of the respective cutting teeth 11 are not to overlap with any of the notches of the fixed blade. Accordingly, the hair entering the notches are all cut without fail. On the other hand, the cutting teeth of the movable blade and the cutting notches of the fixed blade are relatively positioned so that the passing timings of the teeth over the corresponding notches thereof will be shifted slightly, and thereby simultaneous cutting of a large volume of hair can be avoided and the load on the movable blade can be highly reduced. Any rising of the movable blade from the fixed blade which is due to overloads and is likely to cause incomplete cuttings can be also avoided. The blades of the above-mentioned structure enables the positive cutting of the hair entering the notches and the reduction of the load on the movable blade. The positive cutting is an essential element for such kind of hair clippers as to cut the hair by moving them along the hair, that is, as to cut the hair only by one chance.

FIG. 5 shows another embodiment of the present invention in which a movable blade 22 slides with respect to a fixed blade 21 and which is featured by the structure of comb-shaping cutting teeth 23–26 of the fixed blade 21. The notch (a) defined between the cutting teeth 23 and 24 is narrower than the one (b) defined between the cutting teeth 25 and 26. Thus notches of a narrower width and of a wider width are arranged alternately. On the other hand, the cutting teeth of the movable blade are all positioned with an equal interval. Further, the depth of the notch of the movable blade is made to be deeper than that of the fixed blade. According to such a structure, entangled hair can be also cut positively, since the hair enters both narrower notches which the cutting teeth cross and wider notches which the cutting teeth do not cross. So-called thin cutting can be carried out well.

Whereas in FIG. 5 the cutting teeth of the fixed blade are varied in the interval therebetween, in FIG. 6, showing still another embodiment of the present invention, cutting teeth of a movable blade 31 are varied in the interval therebetween, that is, the cutting teeth 30 of a fixed blade 29 are positioned with an equal interval whereas the notch defined between the cutting teeth 32 and 33 is narrower than the one defined between the cutting teeth 33 and 34. In this embodiment, the same effect can be obtained as in the embodiment of FIG. 5.

What is claimed is:

1. A hair clipper comprising a fixed blade and a movable blade, said fixed blade including a plurality of notches spaced along an outer edge thereof, said movable blade including a plurality of movable cutting teeth spaced along an outer edge thereof, there being a corresponding tooth for each notch, said movable blade being slidable relative to said fixed blade in pressed contact therewith and at an amplitude of movement such that each cutting tooth of said movable blade completely traverses only one corresponding notch of said fixed blade during a stroke of said movable blade, and at an end of the stroke all of said teeth and notches are disposed in non-overlapping relationship, said notches arranged at a first frequency and said teeth arranged at a second frequency, one of said first and second frequencies being uniform, the other being non-uniform.

2. Apparatus according to claim 1, wherein said one frequency comprises that of said movable teeth.

3. Apparatus according to claim 1, wherein said one frequency comprises that of said fixed teeth.

4. A hair clipper according to claim 1 wherein said fixed blade has the cutting notches of a wider width and of a narrower width which are arranged alternately.

5. A hair clipper according to claim 1 wherein said movable blade has the pitches of a wider width and of a narrower width which are arranged alternately.

* * * * *